US010814947B2

(12) United States Patent
Wilson

(10) Patent No.: US 10,814,947 B2
(45) Date of Patent: Oct. 27, 2020

(54) HARNESS-BASED BUOYANCY CONTROL DEVICE

(71) Applicant: Gordon Wilson, Johnstone (GB)

(72) Inventor: Gordon Wilson, Johnstone (GB)

( * ) Notice: Subject to any disclaimer, the term of this patent is extended or adjusted under 35 U.S.C. 154(b) by 0 days.

(21) Appl. No.: 16/340,649

(22) PCT Filed: Oct. 30, 2017

(86) PCT No.: PCT/EP2017/077840

§ 371 (c)(1),
(2) Date: Apr. 9, 2019

(87) PCT Pub. No.: WO2018/078176

PCT Pub. Date: May 3, 2018

(65) Prior Publication Data

US 2019/0291833 A1 Sep. 26, 2019

(30) Foreign Application Priority Data

Oct. 30, 2016 (GB) ..... 1618307.1

(51) Int. Cl.
*B63C 11/08* (2006.01)
*B63C 11/22* (2006.01)
(Continued)

(52) U.S. Cl.
CPC ..... *B63C 11/08* (2013.01); *B63C 11/22* (2013.01); *B63C 11/2245* (2013.01);
(Continued)

(58) Field of Classification Search
CPC combination set(s) only.
See application file for complete search history.

(56) References Cited

U.S. PATENT DOCUMENTS 2,871,854 A * 2/1959 Lambertsen ..... A62B 7/04 128/205.17
3,129,707 A 4/1964 Becker et al.
(Continued)

FOREIGN PATENT DOCUMENTS

DE 29500888 U1 4/1995
EP 0760337 A1 3/1997
(Continued)

OTHER PUBLICATIONS

UK Search Report dated Nov. 23, 2017 for UK Application No. GB 1717875.7 filed Oct. 30, 2017.
(Continued)

*Primary Examiner* — Kyle Armstrong
(74) *Attorney, Agent, or Firm* — Blue Filament Law PLLC

(57) ABSTRACT

A buoyancy control device having a back panel and including at least one flotation bladder, which at least one flotation bladder is configured with the device for controllable inflation and deflation, and connected thereto a harness arrangement for securing the device to a body of a user, the device having a cylinder-mounting mechanism arranged to enable front or side mounting of at least one breathable gas cylinder is useful for snorkeling and diving or repeated diving from snorkeling. A particularly preferred configuration provides a lightweight device of less than 5 kg and an apparatus of no more than 10 kg whereby carriage to and from snorkeling and/or diving location is simplified.

18 Claims, 10 Drawing Sheets

(51) Int. Cl.
*B63C 11/30* (2006.01)
*B63C 11/02* (2006.01)

(52) U.S. Cl.
CPC ..... *B63C 11/30* (2013.01); *B63C 2011/026* (2013.01); *B63C 2011/085* (2013.01); *B63C 2011/2281* (2013.01); *B63C 2011/303* (2013.01)

(56) References Cited

U.S. PATENT DOCUMENTS

| | | | | |
|---|---|---|---|---|
| 4,810,134 | A | 3/1989 | Eaulconer et al. | |
| 5,662,433 | A | 9/1997 | Seligman | |
| 6,120,213 | A | 9/2000 | Stinton | |
| 2005/0191135 | A1* | 9/2005 | De Felice | B63C 11/02 405/186 |
| 2008/0267715 | A1 | 10/2008 | Sullivan | |
| 2010/0242966 | A1 | 9/2010 | Johnson | |

FOREIGN PATENT DOCUMENTS

| | | | |
|---|---|---|---|
| EP | 1116649 | A2 | 7/2001 |
| EP | 1283161 | A2 | 2/2003 |
| GB | 2298141 | A | 8/1996 |
| WO | 2014035527 | A1 | 3/2014 |

OTHER PUBLICATIONS

International Search Report dated Jan. 19, 2018 for International Application No. PCT/EP2017/077840 filed Oct. 30, 2017.

* cited by examiner

HARNESS-BASED BUOYANCY CONTROL DEVICE

FIELD OF THE INVENTION

This invention pertains generally to snorkelling and diving and more particularly to the field of buoyancy control devices usable in snorkelling and scuba diving, to a scuba apparatus, to a method of assembly or manufacture of a buoyancy control device and to a buoyancy control device kit.

BACKGROUND OF THE INVENTION

Increasing interest in snorkelling and scuba diving is common across many societies. For many, casual participation in surface water snorkelling leads to an interest in scuba diving. Similarly, many existing scuba divers also enjoy snorkelling. In shallow water, typically up to about 9 m (29 ft) deep, particularly near sea walls, reefs and other rock formations, interesting sea life or other aquatic features on or near the bottom may be seen when surface snorkelling at this depth. For a snorkeler, particularly if they also engage in scuba diving, frustration can arise when their ability to dive down to take a closer look is limited to how long they can hold their breath underwater.

Time underwater on a normal snorkel dive on one deep breath is less than the time the snorkeler can hold their breath on the surface due to the positive buoyancy characteristics of snorkelling and the exertion required to swim downwards and maintain a depth underwater. Such exertion consumes oxygen at a greater rate within the body than when the body is at rest.

Snorkelling posture in the water is typically horizontal and face down.

When prepared for scuba diving, wearing a conventional buoyancy control device (BCD), adopting a snorkelling posture is difficult and uncomfortable as it results in a standard size back-mounted air cylinder being out of the water where it is at its heaviest. The effect of this weight is to submerge the diver. In turn there is a requirement for significant buoyancy in the BCD to keep the diver on the surface. As such, conventional BCDs are not compatible with snorkelling.

WO-A-2014/035527 discloses a selectively inflatable water sports inflation device. The device is a vest having an inner layer, an outer layer, and a bladder between the inner and outer layers and having gas canisters coupled to the bladder for selectively delivering pressurized gas into the bladder to provide flotation when actuated. The device also has a pressure release valve for manually actuation to release gas from the bladder. The device is configured to bias the use to face-up configuration and is configured not to impede paddling. It finds particular utility for surfers and participants in similar water sports as a safety device should they get into trouble. There is not provision for buoyancy control as such nor for attachment of cylinders of breathable gas.

EP-A-1116649 discloses a supplied air snorkelling system with an air tank, at least one regulator coupled to the air tank and including a mouthpiece through which air from the tank is provided and an air snorkelling vest. The vest includes a back portion, a front portion, a head opening and a tank holder on the back portion. Flotation material or, if configured as a buoyancy compensator, inflatable chambers are provided on a back portion and a front portion. The main body extends laterally across the snorkeler's chest proximate to the snorkeler's clavicle and the across the snorkeler's sternum body. A head opening is formed at a juncture of the back portion and the front portion. The system is configured for snorkelling and does not enable diving to depths.

It would be desirable to have a system that enabled a snorkeler to comfortably swim at the surface while snorkeling yet occasionally dive down to depths of up to 5 m or even 10 m to explore for more than just a few seconds.

The present inventor has devised an apparatus that addresses the aforementioned need while overcoming the problems with the prior art.

Problem to be Solved by the Invention

There is a need for improvements in apparatus for snorkelers and divers that enables both activities to be carried out with the same equipment.

It is an object of the invention to provide an apparatus for snorkeling which allows occasional and/or repeated dives for extended periods.

It is an object of the invention to provide an apparatus for scuba diving that enables comfortable snorkeling.

SUMMARY OF THE INVENTION

In accordance with a first aspect of the invention, there is provided a harness based buoyancy control device: the harness having a cylinder mounting mechanism arranged to permit frontal mounting of at least one cylinder, and the device having a floatation bladder.

In a second aspect of the invention, there is provided a buoyancy control device for use in snorkeling and scuba diving, the device comprising a back panel comprising at least one flotation bladder, which at least one flotation bladder is configured with the device for controllable inflation and deflation, and connected thereto a harness arrangement for securing the device to a body of a user, the device having a cylinder-mounting mechanism arranged to enable front or side mounting of at least one breathable gas cylinder.

In a third aspect of the invention, there is provided an assembly for use as a buoyancy control device for use in snorkeling and scuba diving, the assembly comprising interengageable elements comprising:

a device body comprising a panel body and a harness arrangement;

at least one flotation bladder; and, optionally a detachable weighting means.

In a fourth aspect of the invention, there is provided an apparatus for snorkeling and scuba diving comprising a device as defined above and one or two breathable gas cylinders mounted thereon so as to be ventrally disposed relative to a user when wearing the apparatus.

In a fifth aspect of the invention, there is provided a flotation bladder configured for use in a device as defined above.

In a sixth aspect of the invention, there is provided a device body configured for use in an assembly as defined above.

In a seventh aspect of the invention, there is provided a weighting apparatus configured for use with a device as defined above or with an assembly as defined above, which weighting apparatus comprises a weighting apparatus support band, disposed on the support band one or more pouches for receiving one or more weights (e.g. standard 2 kg lead weights) and disposed at the ends of the support band releasable fixing means for removably attaching to corresponding releasable fixing means on a waist member, shoulder member or back panel of the device.

In an eighth aspect of the invention, there is provided a use of an apparatus as defined above for snorkeling with occasional and repeated dives (e.g. of up to 9 m, or optionally of up to 18 m).

In a ninth aspect of the invention, there is provided a use of an apparatus as defined above for training in open water diving.

In a tenth aspect of the invention, there is provided a method of manufacturing a device, assembly or component parts thereof as defined above.

Advantages of the Invention

The device and apparatus of the invention enable, by way of the front or side mounting of breathing gas cylinders and provision of primarily dorsal buoyancy through a flotation bladder in a back panel of the device, comfortable use of the device and apparatus for snorkeling and diving or repeated diving from snorkeling. A particularly preferred configuration provides a lightweight device of less than 5 kg and an apparatus of no more than 10 kg whereby carriage to and from snorkeling and/or diving location is simplified.

DETAILED DESCRIPTION OF THE INVENTION

Figure 1:
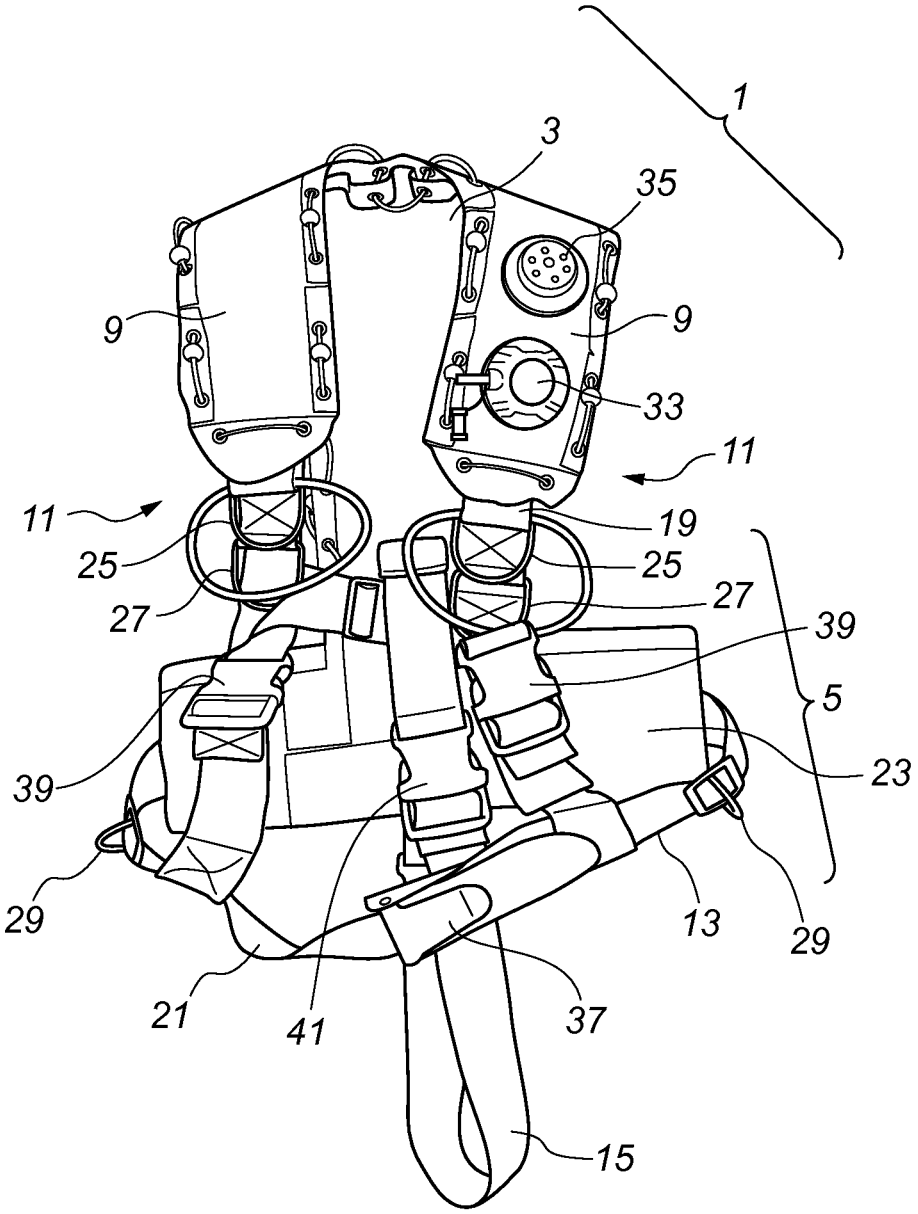
FIG. 1 is a front view of one embodiment of the device of the invention.

The invention is concerned with a buoyancy control device for use in snorkeling and scuba diving. The device (or BCD) is configured to enable or permit front or side mounting (preferably front or ventral mounting) of at least one breathing gas cylinder (and optionally two breathing gas cylinders). The device of the invention is provided with a flotation bladder.

The device preferably comprises a cylinder-mounting mechanism arranged to enable front or side mounting of the at least one breathing gas cylinder. For example, one cylinder may be mounted to extend diagonally across the front of the body of a user, or two cylinders may be mounted to the front or either side of the body of a user, but preferably disposed ventrally thereto.

Preferably, there is no facility or cylinder-mounting mechanism provided on the device to enable back-mounting of a breathing gas cylinder to the device and user.

Thus, the cylinders, in use during snorkelling, may be located below the surface. As the cylinders are buoyed by the water in which they are submerged, and because there is no longer any weight attached to the divers back, the effective weight of the user and cylinder are substantially reduced and so the requirement for buoyancy to maintain the user on the surface and compensate for the weight is substantially reduced. As a result, the device can be much smaller, lighter and transportable than conventional BCDs as well as allowing a user wearing the BCD and carrying breathing cylinders to snorkel, e.g. using a conventional snorkel.

Preferably, the device comprises a back panel comprising at least one flotation bladder. The at least one flotation bladder is preferably configured with the device for controllable inflation and deflation.

Preferably, the device comprises a harness arrangement for securing the device and, in particular, the back panel to the body of a user. The harness preferably comprises the cylinder mounting mechanism.

The flotation bladder is preferably positioned to be disposed over the back and extending over the shoulders of the user, when in use.

The at least one flotation bladder is preferably configured on the back panel to extend laterally so as to be within the lateral profile of the user.

The flotation bladder may comprises one or more inflatable chambers, said one or more inflatable chambers being configured to centre about the spine of a user. Preferably, where more than one inflatable chambers provided, the inflatable chambers are inter-connected so that they may be inflated and deflated by a single inflating device and deflating device or pressure relief valve. Optionally, where more than one inflatable chamber forms the flotation bladder, they may be discrete chambers and require individual inflation and deflation. Preferably, the flotation bladder comprises a single inflatable chamber.

The flotation bladder preferably has a maximum lateral extent of up to 50 cm, optionally up to 45 cm and optionally up to 40 cm. It is preferred that the maximum lateral extent is at least 30 cm, preferably at least 40 cm and most preferably in the range 45 to 50 cm. The back panel, in which the flotation bladder is provided, preferably has a maximum lateral extend corresponding to that of the flotation bladder plus a margin of typically one or two cm either side.

Preferably, in one main embodiment, the back panel comprises a back portion for locating on the back of a user and two shoulder portions, each for extending from the back portion over a shoulder of the user. The back portion may extend from the nape of the neck, where a collar is defined (and also between the shoulder portion), to the small of the back. Thus, the back portion may extend from a nape edge to a base or bottom edge. Preferably, the back portion has a medial extent (e.g. from nape edge to base or bottom edge) of up to 60 cm, more preferably up to 50 cm, more preferably up to 45 cm, still more preferably up to 40 cm. Optionally the medial extent is up to 30 or 35 cm. More preferably, the medial extent is at least 30 cm and more preferably from 30 to 40 cm, still more preferably in the range from 35 cm to 40 cm. Preferably, a back part of the flotation bladder generally corresponds with the back portion (of the back panel) and extends to a similar medial extent as the back portion, less a margin (e.g. up to 5 cm and preferably a cm or two) at each edge (nape edge and base edge). The aforementioned medial extents (and/or lateral extents) preferably apply particularly when the flotation bladder is deflated.

Preferably, each shoulder portion extends from the back portion over the shoulder to a pre-defined position on the user, such as to a sternum (e.g. lower sternum) level or to a level between the axilla and the sternum, more preferably to an axilla level and optionally to or over the clavicle of the user. In a preferred embodiment, the shoulder portion extends over the clavicle to, for example, an axilla level. Thus, each shoulder portion may extend by up to say 30 cm, more preferably by up to 25 cm from the back portion (i.e. from the nape edge) and optionally by up to 20 cm. In any case, each shoulder portion should preferably extend by at least 15 cm from the back portion.

The flotation bladder, as mentioned above, preferably extends into the shoulder portions, and preferably to the extent of the shoulder portion (less say 1 to 3 cm at a distal edge thereof).

The back portion may define any suitable shape, provided, in a preferred embodiment, its maximum lateral extent does not extend beyond the lateral profile of the user. Optionally, for example, the back portion may define a shape selected from a Y-shape, a figure-of-eight or egg-timer shape, a tapered trapezoid or rhombus shape or a generally oblong shape or oval shape. In one preferred embodiment, the back portion defines a generally parallel or inwardly tapering shape from a broad point at about the scapula level toward the base edge where at a point proximal thereto it begins to curve in to the base edge (for example, the side edges may define a gentle s-shaped or f-shaped curve).

In a preferred embodiment, the back portion has a maximum lateral dimension at a scapula level.

In one embodiment, the lateral dimension of the back portion at scapula level is about 30 to 35 cm, or even up to 40 cm, preferably about 33 cm. Preferably, the lateral dimension (or width) at mid-level (between the nape edge and base edge) is from 20 to 30 cm, more preferably 25 to 30 cm, still more preferably 27 to 29 cm. Preferably, the lateral dimension at the bottom portion (e.g. 5 cm from the base edge) is from 15 to 20 cm, e.g. from 17 to 19 cm. In another embodiment, where the back portion defines a figure of eight or egg-timer shape, the mid-level lateral dimension may be less, e.g. from 15 to 30 cm, e.g. up to 25 cm (e.g. from 20 to 25 cm) whilst the bottom portion may be wider, such as from 20 to 30 cm, .g. 25 to 30 cm.

Preferably, the flotation bladder has a maximum inflation capacity in a dorsal dimension over the spine of a user.

Preferably, the device is absent any cylinder-mounting mechanism on the back portion of the back panel. More preferably, the device is absent means for mounting a cylinder on the user's back.

Being of relatively modest size the integrated floating bladder of a preferred embodiment may be positioned over the diver's back and shoulders in use. In some embodiments the device may be arranged to be worn with swim shorts or a swimsuit or the thin short wetsuit typically used by a user when warm water surface snorkelling. Alternatively, the device may be arranged to be worn with a full wetsuit, e.g. a 5 mm wetsuit.

Preferably, the user may be enabled to view the amount of air in a cylinder and so preferably a pressure gauge is provided, e.g. incorporated with the regulator or cylinder or mouthpiece. Accordingly, when a user wants to dive down they may switch from their snorkel to a breathing regulator fitted to the cylinder with the most air in it, causes the flotation bladder to deflate so as to sink in a state of slightly negative buoyancy. When the user wants to return to snorkelling they swim to the surface and re-inflate the flotation bladder to do so. In order to do this the user may be enabled to transfer air from one or more of the cylinders to the bladder. This transference may be controlled by a control, regulator cylinder or mouthpiece, and/or may comprise a separate pathway and/or diverter.

Preferably, an inflator mechanism for the flotation bladder is disposed in a shoulder portion of the back panel (and thus correspondingly into a shoulder part of the flotation bladder). The inflator mechanism is preferably fed by an inflation tube from the tank, e.g. from a first or second regulator. In one embodiment, the inflator mechanism comprises a protruding push-button inflator or integrated dry suit-type centre-press inflator.

Preferably, a dump valve and/or pressure release valve for the flotation bladder is disposed in a shoulder portion of the back panel (and thus correspondingly into a shoulder part of the flotation bladder). This may be in the same or different shoulder portion to the inflator mechanism.

In a preferred embodiment, the device does not provide any inflatable flotation means that will extend forward adjacent the sides of a wearer (e.g. beneath the arms, when at rest) nor to the front of a user at a level below the preferred shoulder portions of a back panel. It is further preferred that there is no flotation means disposed in the device to the sides or the front (e.g. relative to a user wearing the device) other than that provided by the shoulder portions of the back panel. Thus, it is preferred that the buoyancy provided by the device is primarily provided by that portion of a flotation bladder disposed in relation to the back portion of the back panel. Preferably, the back portion comprises at least 70% of the volume of the flotation bladder, more preferably at least 75% still more preferably at least 80% and optionally at least 90%.

Preferably, as discussed above, the device comprises a harness arrangement. The harness arrangement preferably comprises a waist member which is configured to extend from each lateral edge of a back portion about a waist of user; and preferably two shoulder members each configured to extend from a shoulder of a user to engage with the waist member.

Preferably, the cylinder-mounting mechanism comprises mounting members located on the harness arrangement. In one embodiment, the cylinder-mounting mechanism comprises a first mounting member located on a shoulder member and a second mounting member, preferably located on a waist member. The shoulder member may comprise the shoulder portion of the back panel and optionally a shoulder strap member extending from (and optionally coexisting with) the shoulder portion.

The waist portion typically comprises a waist belt extending form a lower portion of the back panel and configured to connected together about the front of a user. Optionally, the waist portion comprises a waist support, which may comprises a wider and optionally padded band about the rear and optionally about the sides of the device (and user)—it may be affixed to the base edge of base portion of the back panel. Optionally, the waist portion may support weights, preferably removably attachable weights by way of a weighting means. The weighting means may preferably comprise a detachable pocket or pouch for receiving weights. The weighting means is preferably attachable to the waist member (e.g. by pinch connectors). The weighting means may alternatively be attachable to the shoulder member or to the back panel. The weighting means preferably comprises a pouch suitable for holding up to 4, optionally up to 8, 2 kg standard lead weights. Thus, the weighting means may be readily removed if need be during use. Optionally, more than one detachable weighting means may be accommodated in the device.

The shoulder members preferably extend to connect with the waist member. This is typically by way of a shoulder strap from the shoulder portion of the back panel to the waist portion. The shoulder strap is preferably provided with a connector such as a pinch connector to enable it to be disconnected from the waist member. Preferably, a chest strap is provided to connect the two shoulder members (e.g. from one shoulder strap to another) and is preferably provided with a connector so that the chest strap can be disengaged (to enable the device to be put on and off.

The harness arrangement preferably further comprises a crotch harness member configured to extend from a lower edge of the back panel, over a crotch area of a user to a waist member.

Each of the portions or members of the harness arrangement are preferably adjustable so as to be adjusted to fit a particular user snugly and comfortably.

Preferably, the one or more shoulder members, waist member and crotch harness member as well as chest strap comprise straps of webbing.

The cylinder mounting mechanism may comprise a connector, such as a D-ring, disposed on the shoulder member, which may be on a distal portion of the shoulder member or a shoulder strap. Optionally, connectors (e.g. D-rings) are disposed at two or more locations on the shoulder member so as to accommodate more than one size of cylinder. The cylinder mechanism may further comprise a second connector (e.g. D-ring) disposed on the waist portion, such as on a waist strap or belt, and optionally located on the side or fore-side of the waist member to be located at a corresponding position of the user.

Preferably, the cylinder-mounting mechanism is such as to dispose a cylinder ventrally to the user.

Thus, in use, the one or more cylinders may be disposed so as not to interfere with snorkeling activity, such as swimming action.

The location of the cylinders coupled with flotation bladder disposed in relation to the back panel of the device serve to provide buoyancy and balance which facilitate snorkeling whilst allowing the opportunity for the user to take a regulator and dive for a relatively extended period (e.g. considerably more than can be achieved on a breath of a typical user) and optionally for multiple extended periods.

The device of a one embodiment of the invention provides up to 20 kg lift capacity, but is preferably smaller so as to be more portable and comfortable to wear so may provide up to 10 kg lift capacity in another embodiment. In a still further embodiment, the device may have a lift capacity of up to 5 kg.

The device may suitably weigh, absent trimming weights and excluding cylinder and associated apparatus, up to 8 kg, more preferably up to 5 kg, still more preferably up to 3 kg and still more preferably up to 2.5 or even 2 kg.

The device preferably comprises an assembly of parts.

An assembly of parts according to a preferred embodiment of the device and a further aspect, comprises a device body comprising a panel body and a harness arrangement, a flotation bladder and optionally a detachable weighting means. The flotation bladder and weighting means are as defined above and further described hereinafter. According to this aspect, the device body corresponds to the device as defined above absent a floatation bladder. The device body thus comprises a panel body corresponding to a back panel as defined above, absent the floatation bladder. The panel body preferably comprises an inner layer and an outer layer defining a panel cavity which may receive a floatation bladder.

Thus, a method for manufacturing a buoyancy device comprises providing the parts of the assembly defined above, fitting the floatation bladder and optionally weighting means to the panel body, and optionally attaching any webbing to provide the harness arrangement. The parts may be made in accordance with any suitable method, such as described below.

In another aspect, as discussed above, there is an apparatus for snorkeling and scuba diving comprising a device as defined above and one or two breathable gas cylinders mounted thereon so as to be ventrally disposed relative to a user when wearing the apparatus.

The apparatus preferably comprises at least one regulator, inflator hose and at least one surface pressure gauge.

Preferably, the apparatus comprises two breathable gas cylinders, each mounted to one of two cylinder mounting mechanisms provided on the device so as both cylinders are ventrally disposed relative to a user when wearing the apparatus.

In one embodiment, each cylinder has a capacity of up to 3 liters, or even up to 2 liters and optionally up to 1 liter. Such cylinders find utility in snorkeling activity with occasional dives of up to say 5 m, or more typically up to 9 m.

According to this embodiment, the apparatus has a total weight of up to 15 kg, preferably up to 10 kg. Thus, it is very portable, may be transported to remote places, is easy to carry and fit and very suitable for snorkeling with occasional and repeated dives.

In another embodiment, each cylinder has a capacity of up to 5 liters or even up to 7 liters. With such an arrangement, the apparatus is suitable for use in diving up to 18 m in depth and for extended periods and yet may be comfortable and convenient to wear when snorkeling. Such an apparatus may be used in open water diver training.

As mentioned above, a harness based buoyancy control device in which the harness has a cylinder mounting mechanism arranged to permit frontal mounting of at least one cylinder, and the device having a floatation bladder is provided.

Such cylinders may comprise small "pony" tanks of compressed air, comprising in use at least one regulator coupled to the tank and one mouthpiece regulator through which air from the tank is provided to a user.

A cylinder mounting mechanism may be arranged to mount more than one cylinder at a time. In some embodiments the mechanism may be arranged to mount a single cylinder and/or plural cylinders according to user preference.

A cylinder mounting mechanism may be arranged to mount the cylinder to a side of a user in use. A mechanism may be arranged to permit balanced mounting of such cylinders, for example to either side of the user. In use the device harness in one embodiment permits the user to carry two small compressed air pony cylinders in a frontal configuration while surface snorkelling with the flotation bladder inflated. The regulator, cylinder or mouthpiece may comprise a control for control of transference of air. Each cylinder may comprise a separate control.

In one or more embodiments, the device of the present invention recognises the potential to develop the activity of warm water snorkelling in shallow water by addressing the frustration of not being able to dive down underwater for a meaningful time to permit the snorkelling user a close look at sea life or other aquatic objects of interest; and anticipates that the user will spend time surface snorkelling, but when interest merits closer investigation will make repeated vertical dives for example up to a depth of up to about 9 m (29 ft), each dive having a duration of a few minutes.

In contrast to the prior art, the amount of flotation required may be reduced by reducing the size of the air supply from one large cylinder to two small cylinders, and/or by moving the air supply from the user's back, where it is required to be partially buoyed in the air, to the user's front where the cylinders are substantially buoyed by the water in which they are submerged. In this way size, placement and shape of the harness and integrated flotation bladder permits front-side mounting of the cylinders while snorkelling.

Some embodiments of the device may comprise a light weight harness from webbing or straps. This webbing may incorporate a central back plate with straps leading over the user's shoulders in use to provide front straps which lead down and/or across the user's torso in use, and are connected to a waist belt, and a crotch strap arranged in use to travel through the legs of the user, so as to connect back to the back plate (or back panel).

The harness may optionally comprise pinch connectors, and may include at least one quick release buckle.

In some such embodiments the back plate (or back panel) may comprise a central portion and may be padded for comfort and may comprise a small "Y" shaped floatation bladder within a protective elasticated sleeve.

The shoulder straps may be padded.

In some embodiments the device may comprise a weighted part (for example arrangeable at retail or manufacture) or weighting means (for example enabling adjustment of weight), so as to act to maintain the correct level of buoyancy according to user or user preference. For example the device may comprise displaceable weights. In some embodiments the waist belt may incorporate trimming weight pockets, for example capable of accepting up to 2 kg (4 lb 7 oz) lead weights each (maximum total anticipated trim weight capacity 6 kg, or 13 lb 2 oz).

The invention will now be described in more detail, without limitation, with reference to the accompanying Figures.

Figure 2:
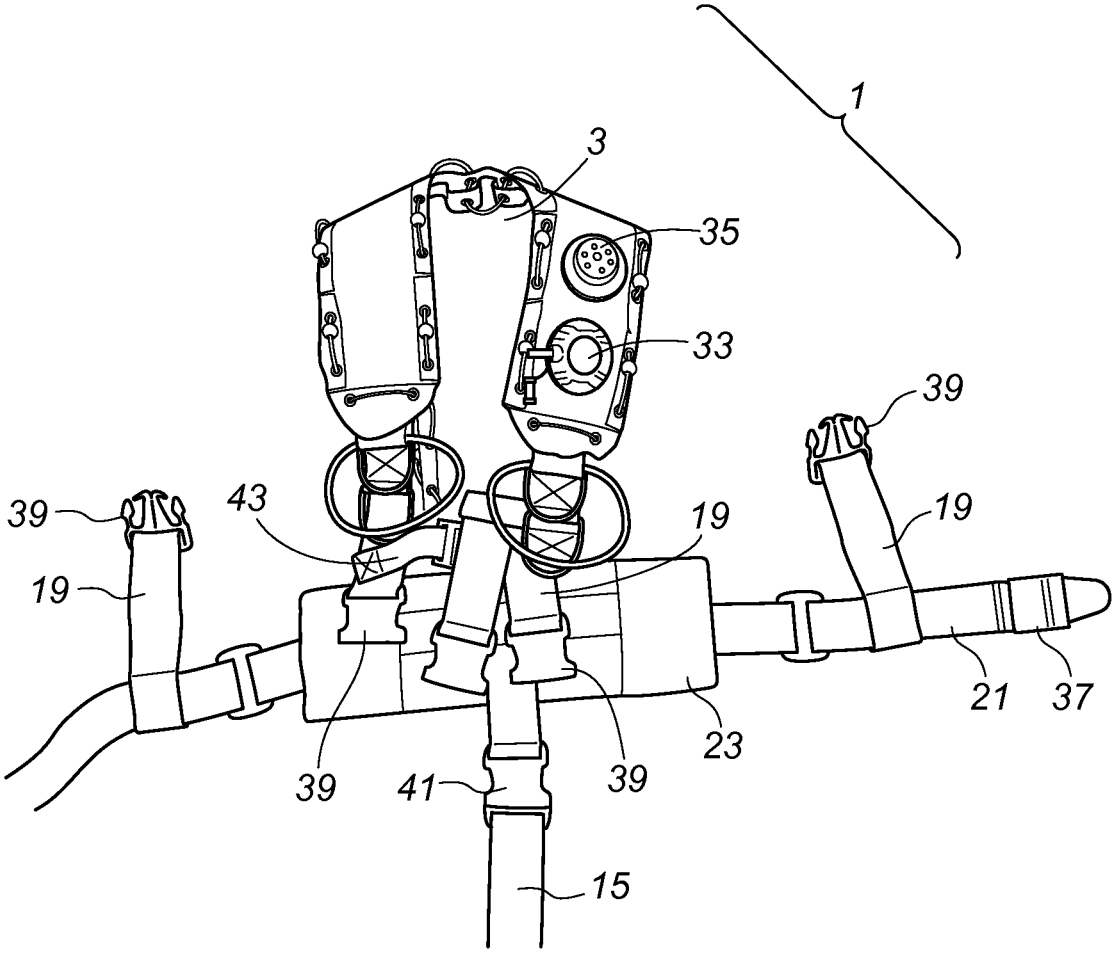
FIG. 2 is a second front view of the embodiment of FIG. 1, with certain straps in an opened configuration.
Figure 3:
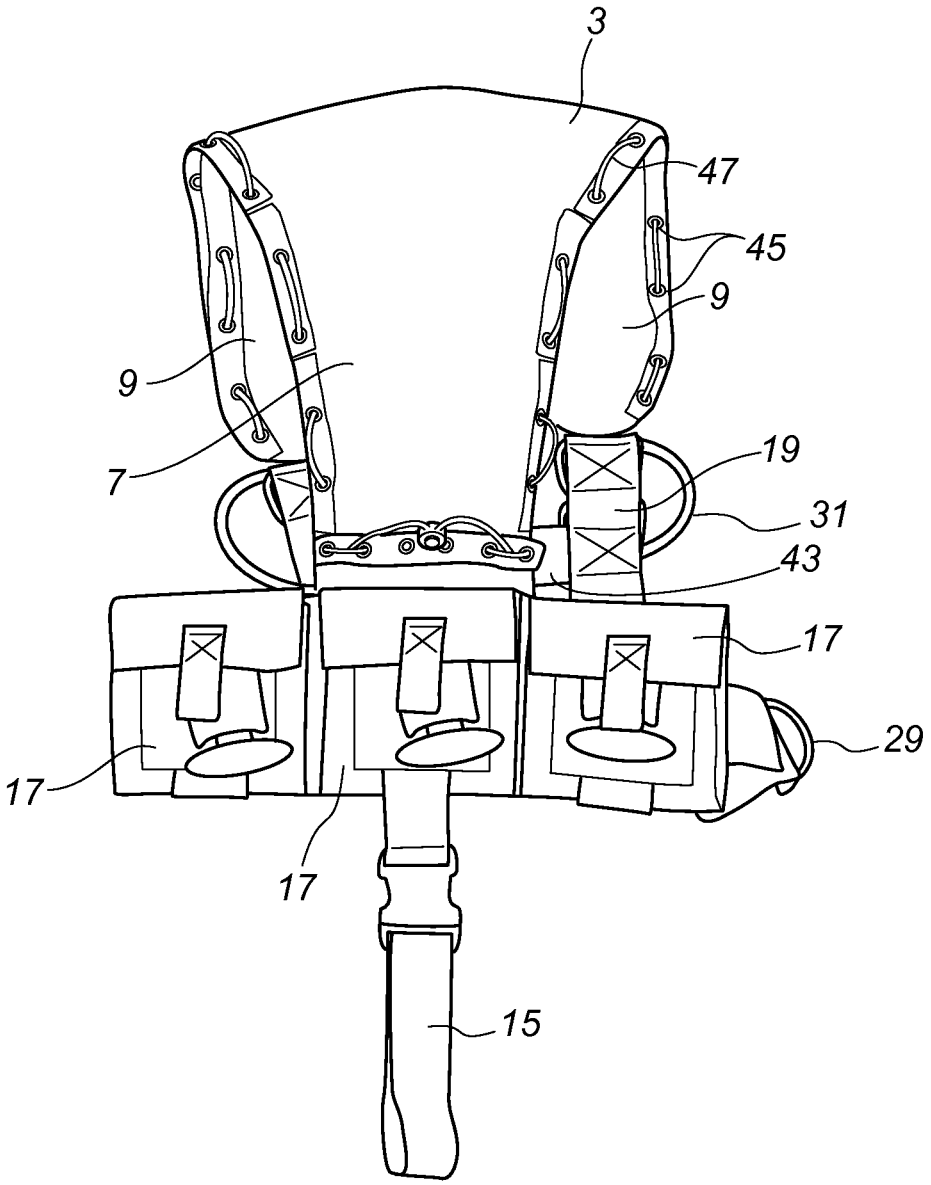
FIG. 3 is a rear view of the embodiment of FIG. 1.
Figure 4:
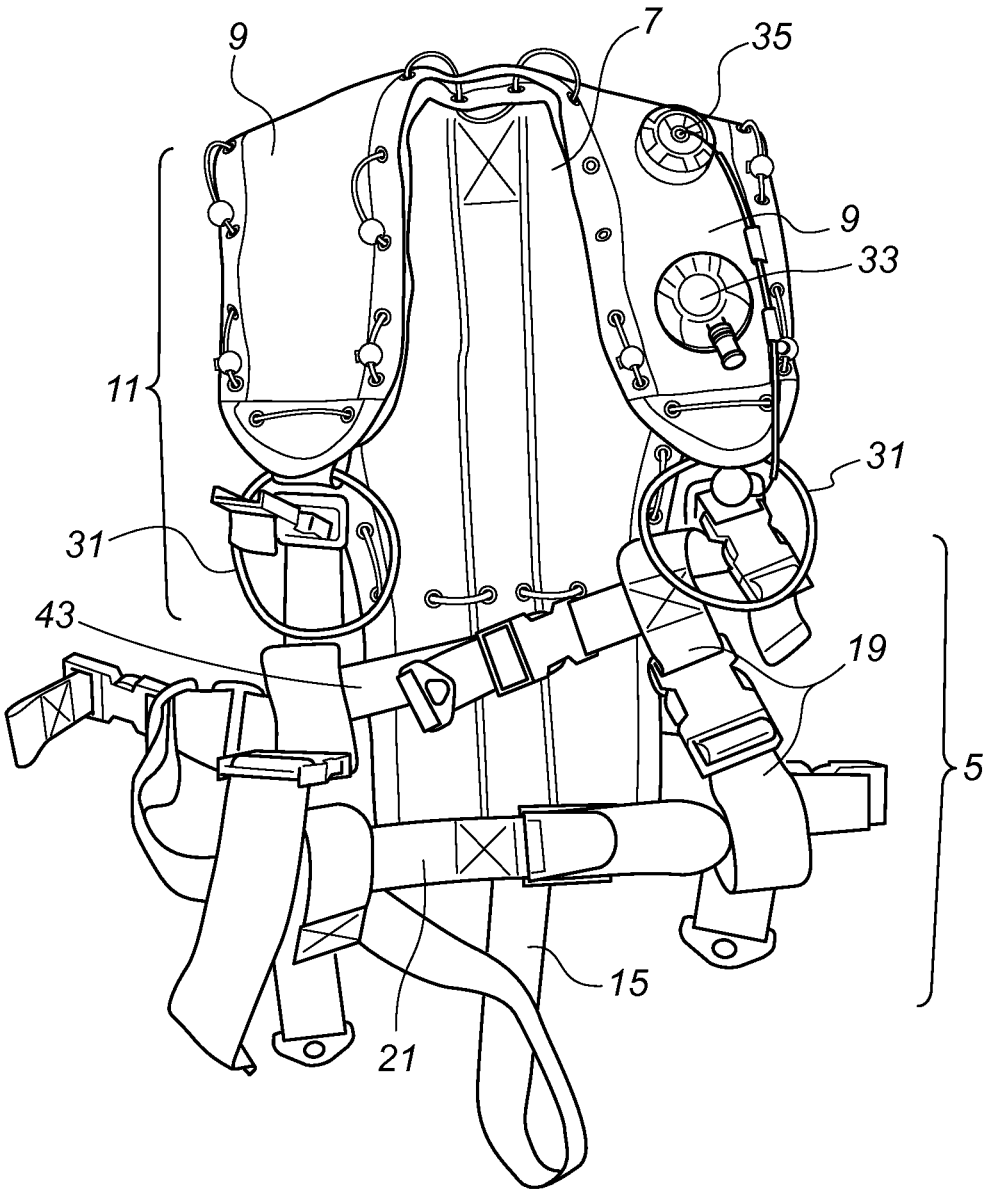
FIG. 4 is a front of view of a second embodiment of the device of the invention.
Figure 5:
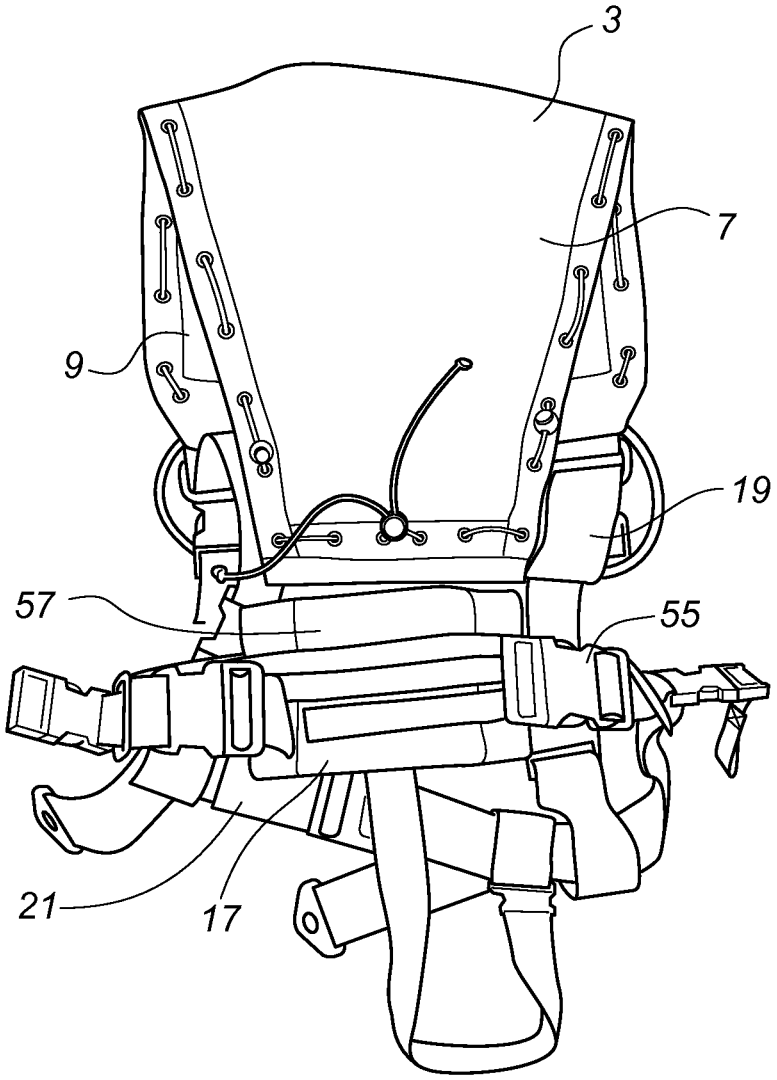
FIG. 5 is a rear view of the second embodiment of the device shown in FIG. 4.
Figure 9:
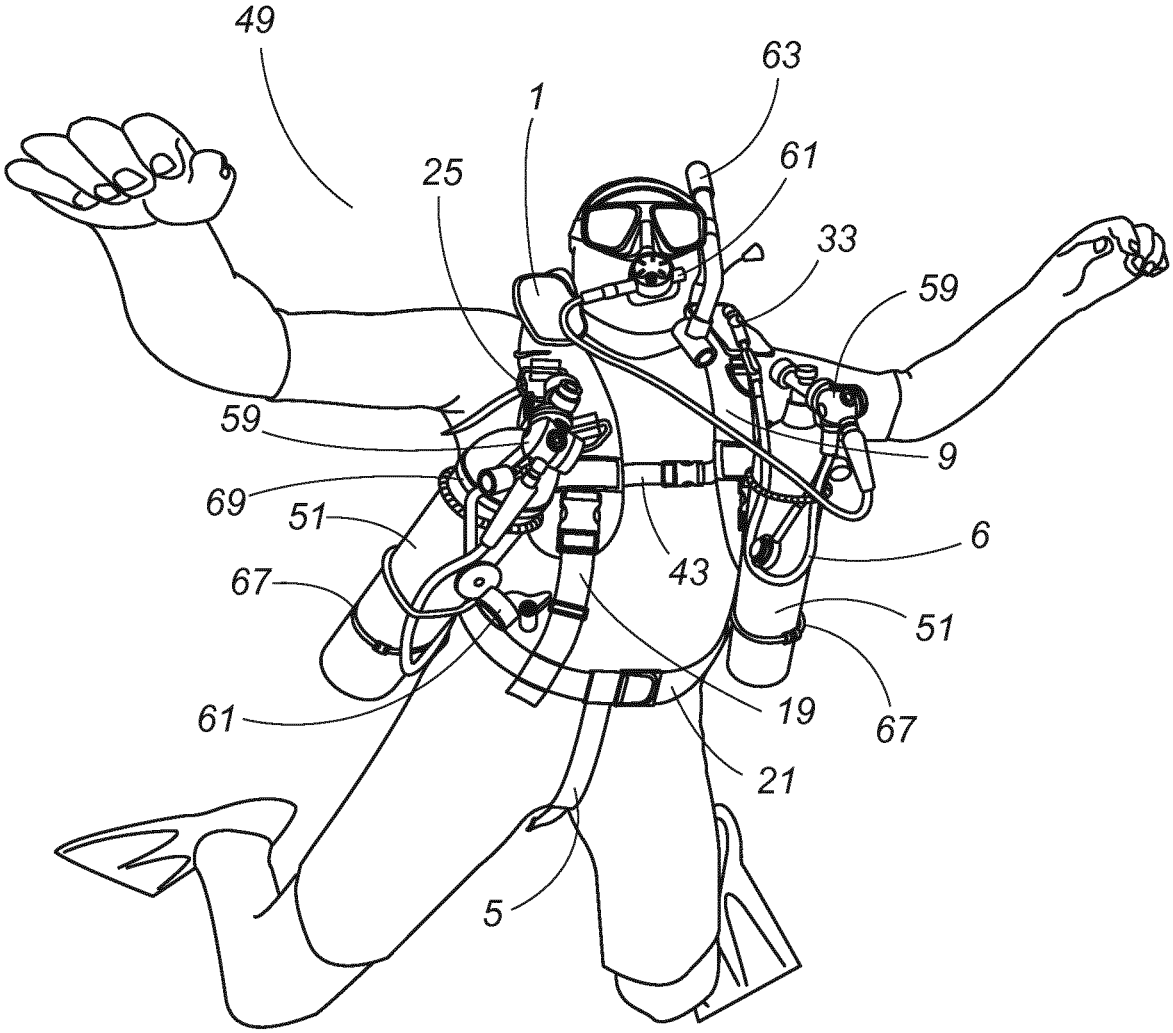
FIG. 9 illustrates a view of one embodiment of the device and apparatus of the invention in use, worn by a snorkeler/diver.
Figure 10:
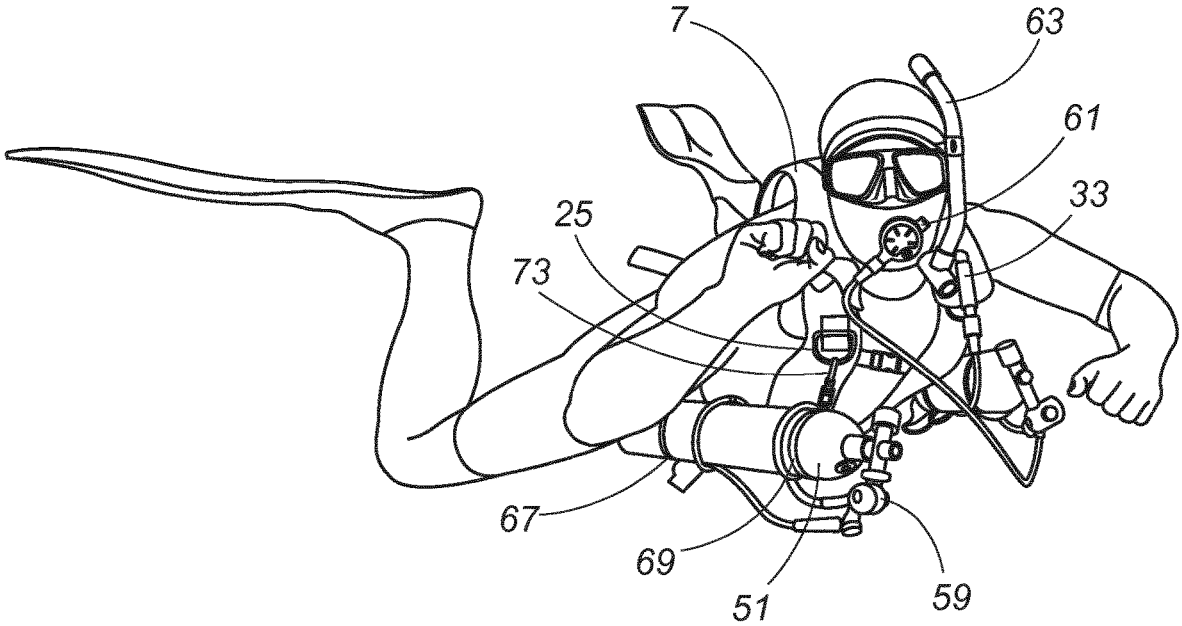
FIG. 10 is a second view of an embodiment of the device and apparatus of the invention shown in FIG. 9, again in use and worn by a snorkeler/diver.

In FIGS. 1 to 3 is illustrated a first embodiment of a device of the invention. Further embodiments are illustrated in FIGS. 4 and 5 and then in FIGS. 6 to 8. FIGS. 9 and 10 illustrate a diver provided with an apparatus of the invention including a device of one embodiment.

A device 1 of FIGS. 1 to 3 comprises a back panel 3 comprising a back portion 7 and shoulder portion 9. The back panel 3 comprises a flotation bladder which extends through the back portion 7 and into the shoulder portion 9. A push button inflator 33 (or integrated dry suit type centre press inflator) enables the flotation bladder to be inflated, whilst a pressure release valve 35 enables it to be deflated as required. The harness arrangement 5 comprises a shoulder member 11, a waist member 13 and a crotch member 15. The shoulder member 11 comprises the shoulder portion 9 and shoulder strap 19 which extends via shoulder strap pinch connector 39 to link with waist strap or belt 21 of the waist member. A waist support extends the waist member to link with the back panel 3. Waist strap 21 is fixed together with quick release buckle 37.

Back panel 3, at back portion 7 and shoulder portion 9, is padded for comfort. The back plate or back panel 3 incorporates a small "Y" shaped floatation bladder within a protective elasticated cover.

The inflator 33 may be fitted with a standard Din QD or CEJN low pressure hose connector at scapula level and an integrated pull cord or twist dump valve with over pressure release 51 at clavicle level on the left shoulder strap.

The back panel 3 is formed in single pieces from a body-contoured template and formed using 2 mm Nylon® or similar backed neoprene, lined with a protective cover of black Cordura® or similar PU backed heavy-duty Nylon® fabric.

The harness straps are formed with 50 mm polypropylene strap webbing and comprises: left and right shoulder straps 19; a central rear strap depending from the back plate or back panel 3 continuing to form a crotch strap 15; a lateral back tie strap; and filler pieces; all stitched to the back panel 3.

The lumbar vertebrae weight supporting waist support 23 is cut in single pieces from a body contoured template and formed using 2 mm Nylon® or similar backed neoprene lined on both sides with protective covers of black Cordura® or similar PU backed heavy duty nylon fabric and then stitched to the back panel 3.

The shoulder members 11 include padding and each of the left and right shoulder straps are fitted with up to three fixed stainless steel "D" rings 25 and a quick release plastic pinch buckle 39 terminating in a 60 mm waist belt loop.

These "D" rings are at scapula level, sternum level and below sternum level so as to accommodate 3-liter, 2 liter or 1 liter pony cylinders, which are mounted front and/or side of the user.

The waist member 13 and waist belt 21 also incorporates the moveable left and right stainless steel "D" rings 29 so as to accommodate 3 liter, 2 liter or 1 liter cylinder mounts front, bottom, and side respectively.

The crotch strap 15 is fitted with a quick release plastic pinch buckle 41 terminating in an 80 mm waist belt loop. The chest strap is formed using 40 mm polypropylene strap webbing and is stitched to the left and right shoulder straps and fitted with a quick release plastic pinch buckle.

The waist member 13 and in particular the waist support 23 further comprises three trimming weight pockets 17, which are located in the lumbar vertebrae region of the back, and are capable of accepting up to 2 kg (4 lb 6 oz) standard lead weights each providing an even weight distribution carry capacity from 1 kg (2 lb 3 oz) to 6 kg (13 lb 2 oz).

Such weight pockets 17 are cut in squares each to accommodate a 1 kg or 2 kg standard lead scuba weight and formed using 2 mm Nylon® or similar backed neoprene lined on both sides with protective covers of Cordura® or similar PU backed heavy duty nylon fabric, black on the inside face and high-vis yellow on the outer face.

The weight pocket 17 have sides, bottoms and cover flaps formed using 50 mm polypropylene strap webbing all stitched to the lumbar vertebrae weight support panel or waist support 23.

The cover flaps are secured to the weight pockets 17 using Velcro® or similar. The weight straps are formed using 50 mm polypropylene strap webbing secured with Velcro® or similar and end fitted with an easy grab yellow plastic toggle.

The waist belt 21 is formed using 50 mm polypropylene strap webbing threaded on the outside of the lumbar vertebrae weight support back panel or waist support 23 and underneath the weight pockets 17. The waist belt 21 is fitted with left hand right hand movable stainless steel "D" rings 29 and a stainless steel quick release buckle 37 mounted for standard right hand release. The structural harness shoulder straps 19 and crotch harness 15 loop onto the waist belt 21.

The flotation bladder is cut in single pieces from a body contoured template and formed using black UV-resistant 560 gms PVC heavy duty fabric bonded together using two part heavy-duty PVC adhesive.

The flotation bladder is disposed within the back panel 3 having a cover panel cut in single pieces from a body contoured template formed of 2 layers of high-vis yellow Cordura® or similar PU backed heavy duty Nylon® or similar fabric. This cover panel is attached to the back plate using 6 mm eyelets threaded with 4 mm black elasticated shock cord 61 fitted at key points with tensioners to permit bladder expansion and adjustment.

FIGS. 4 and 5 illustrate another embodiment that corresponds largely with FIGS. 1 to 3. In FIGS. 4 and 5, back panel 3 has a back portion 7 which defines an inwardly tapering shape from a broad scapula region to a narrower portion in the lower back. This accommodates a larger flotation bladder with the buoyancy balanced further toward the lower back than in the first embodiment of FIGS. 1 to 3 and thus provides a more suitable buoyancy for horizontal snorkelling, particularly with a larger cylinder.

Further, there is provided a single weight pouch 17 which is detachable from waist belt 21 by pinch connectors 55, thus a weight pouch 17 and the weight it contains can be readily removed and dumped if need be.

Figure 6:
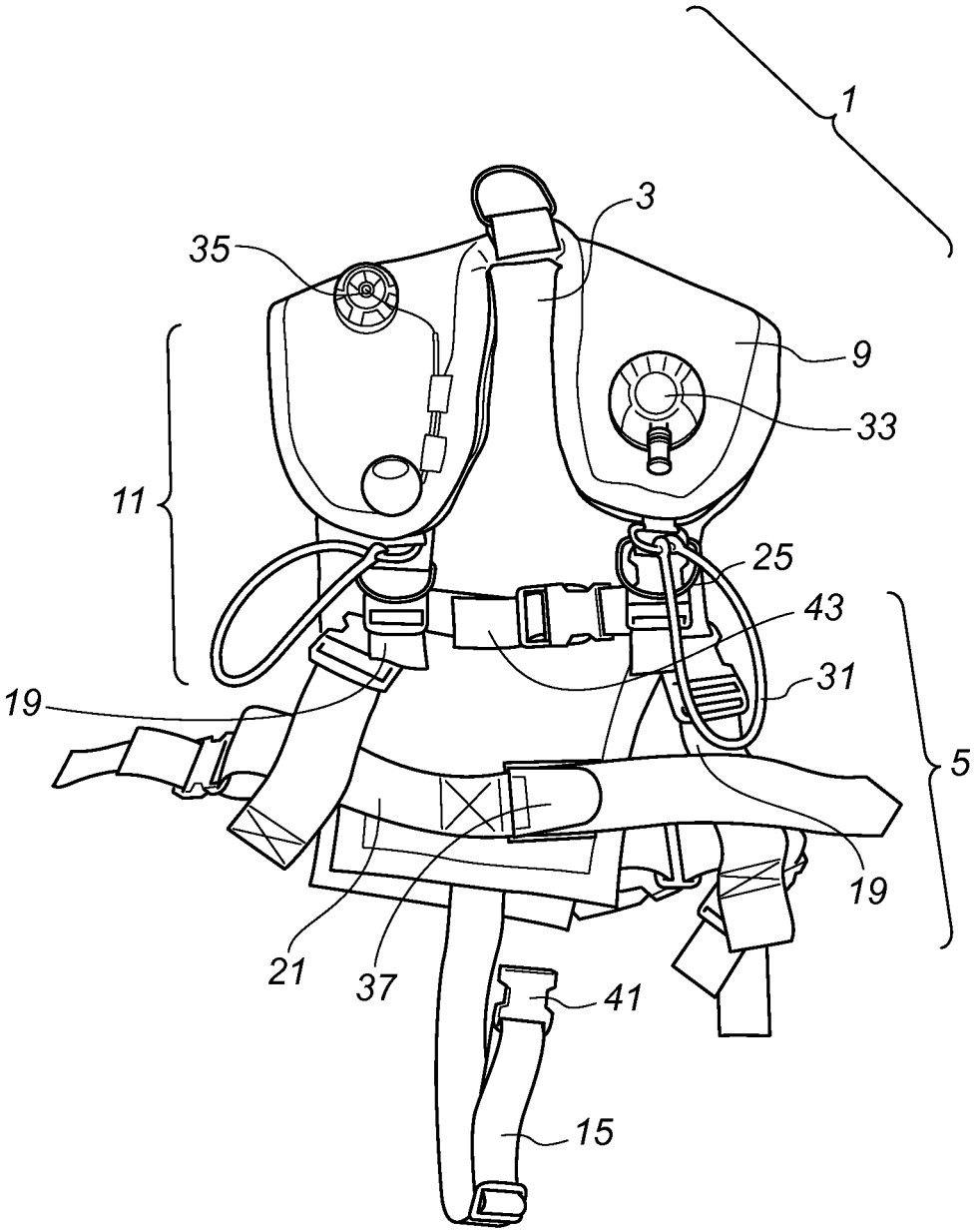
FIG. 6 is a front view of a third embodiment of the device of the invention.
Figure 7:
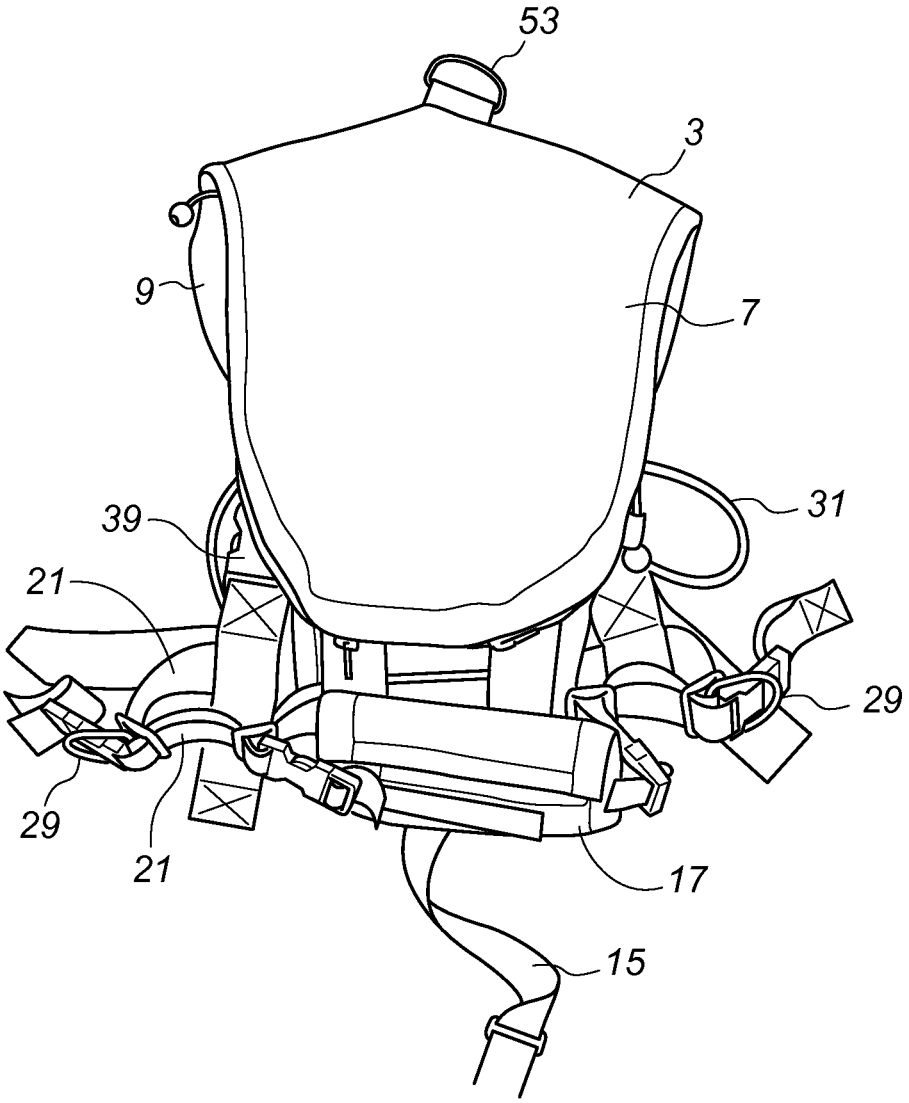
FIG. 7 is a rear view of the third embodiment of the device shown in FIG. 6.
Figure 8:
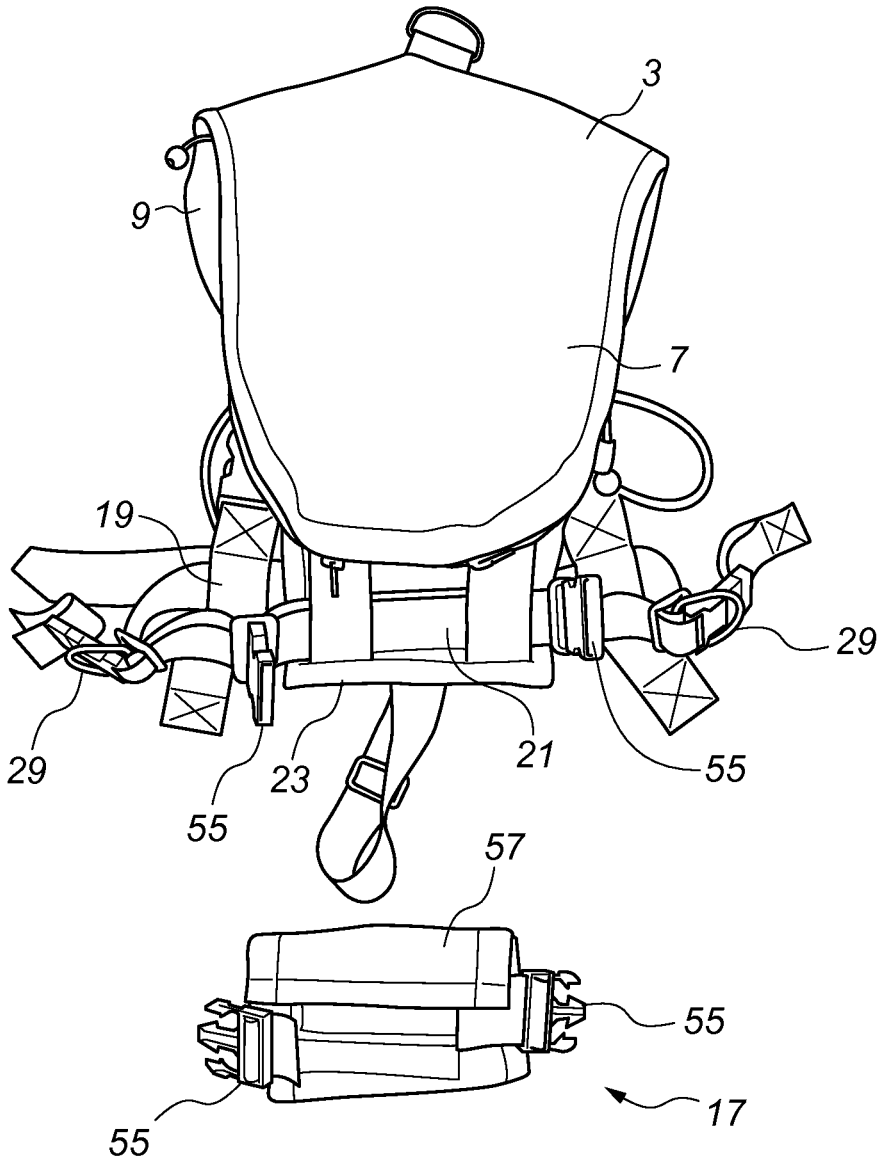
FIG. 8 is a rear view of the third embodiment of the device shown in FIG. 6 with detached weighting pouch.

FIGS. 6 to 8 illustrate a further embodiment of a device 1, again comprising a back panel 3 and harness arrangement 5. Back panel comprises back portion 7 and shoulder portion 9, with in this case the inflator 33 on one shoulder and the pressure release valve 35 on the other. Chest strap 43 is illustrated connecting shoulder straps 19. Shoulder member 11 is illustrated, made up of shoulder portion 9 and shoulder strap 19. As well as D-ring 25, there is illustrated loop 31 which may be used to bind about a regulator so as to hold it toward the front of a user or toward the side.

The back portion 7 is again larger than in FIGS. 4 and 5 and gently curves from a broad scapula portion to the base end. Thus, a larger cylinder arrangement cane be provided enabling diving to 18 m for extended periods.

An alternative weight pouch 17 is illustrated.

With reference to the pictured embodiments, including FIGS. 9 and 10, there is shown a light weight purpose designed buoyancy control device 1 arranged to carry in use on a diver 49 compressed air cylinders 51, with a rear arrangement of floatation bladder.

The device provides a back panel 3 having a back portion 7 leading to two padded shoulder portions 9, extending into a Y shape over the user's shoulders, with an elastomeric gusset therebetween.

This comprises a light weight harness constructed from polypropylene strap webbing, Cordura® or similar PU backed heavy duty Nylon® or similar fabric and Nylon® or similar backed neoprene fabric, the pictured embodiment of the harness 3 providing a mounting mechanism for two cylinders, and a rear deployable floatation bladder.

In the pictured embodiments the cylinders 51 comprise a twin pony tank side mounting mechanism which will provide the user with a secondary air supply and second stage breathing regulator such that in the event of an out-of-air situation the user simply switches from the affected pony.

The cylinders 51 are linked to D-rings 25 by linkage 73 attached to loop connectors 69 (and 67 connected to D-ring 29).

This provides a light and simple harness based buoyancy control harness (BCH) 1 which further incorporates the small floatation bladder and when coupled with the modest air supply provision of the cylinders 51 is designed to be worn with swim shorts/swimsuit or the type of thin shorty wetsuit typically used when warm water surface snorkelling using snorkel 63.

In other embodiments the cylinders may comprise a single 5-liter pony cylinder rigged for diagonal or central front mount or two 5 or 7 liter cylinders 51.

The cylinders 51 are fitted with first stage regulators 59, second stage regulators 61 and a bladder connection 33.

Bearing in mind the open water shallow characteristics of envisaged usage of the device provision of a secondary second stage breathing regulator (or octopus) is not envisaged to be necessary in the pictured embodiment, unless deeper dives and considered.

Further embodiments may include such regulator or octopus, but with the pictured embodiments in an out of air emergency the user may simply ascend the short distance to the surface as they would do if they had made the dive on a single deep breath, with the only difference being the need to exhale during ascent to prevent the possibility of lung over expansion injury.

The invention has been described with reference to a preferred embodiment. However, it will be appreciated that variations and modifications can be effected by a person of ordinary skill in the art without departing from the scope of the invention.

The invention claimed is:

1. A buoyancy control device for use in snorkeling and scuba diving, the device comprising a back panel comprising at least one flotation bladder, which at least one flotation bladder is configured with the device for controllable inflation and deflation, and connected thereto a harness arrangement for securing the device to a body of a user, the device having a cylinder-mounting mechanism arranged to enable front or side mounting of at least one breathable gas cylinder wherein the back panel comprises a back portion for situating on the back of the user and two shoulder portions, each for extending from the back portion over a shoulder of the user and wherein the flotation bladder extends into the shoulder portions; and further comprising two breathable gas cylinders, each mounted to one of two cylinder mounting mechanisms provided on the device so as to be ventrally disposed on either side of a user torso when wearing the apparatus, and configured for repeated diving with each dive of a few minutes in duration.

2. The device as claimed in claim 1, wherein the at least one flotation bladder is configured on the back panel to extend laterally so as to be within the profile of the user, wherein the flotation bladder comprises one or more inflatable chambers, said one or more inflatable chambers being configured to centre about the spine of a user and having a maximum lateral extent of up to 40 cm and wherein the flotation bladder has a back part having a medial extent from a nape edge to a base edge of up to 50 cm.

3. The device of claim 2, wherein the inflator mechanism comprises a protruding push-button inflator or centre-press inflator.

4. The device of claim 1, wherein each shoulder portion extends from the back portion over the shoulder to an axilla level and over the clavicle of the user.

5. The device as claimed in claim 1, wherein the back portion extends from the nape of the neck, where a collar is defined, to the small of the back and wherein the flotation bladder extends into the shoulder portion by an extent of up to 30 cm from the back portion.

6. The device of claim 1, wherein the back portion has a medial extent of up to 60 cm.

7. The device of claim 1, wherein the back portion comprising the floatation bladder defines a Y-shape, a figure-of-eight or egg-timer shape or a generally oblong shape.

8. The device of claim 1, wherein the harness arrangement comprises: a waist member which is configured to extend from each lateral edge of a back portion about a waist of user; and two shoulder members each configured to extend from a shoulder of a user to engage with the waist member; and a crotch harness member configured extend from a lower edge of the back panel, over a crotch area of a user to a waist member, and wherein the cylinder-mounting mechanism comprises a first mounting member located on a shoulder member and a second mounting member located on a waist member.

9. The device of claim 1, wherein the cylinder-mounting mechanism is such as to dispose a cylinder ventrally to the user.

10. The device of claim 1, which provides up to 10 kg lift capacity.

11. The device of claim 1 further comprises a weighting means for enabling adjustment of weight, the weighting means comprising one or more pockets for receiving one or more weights the weighting means secured to the waist member of the harness arrangement and being detachable therefrom during use.

12. The device of claim 1, which has a weight, without trimming weights, of up to 3 kg.

13. The apparatus of claim 1, wherein each cylinder has a capacity of up to 3 litres.

14. The apparatus of claim 1 wherein the apparatus comprises two breathable gas cylinders mounted thereon, at least one regulator, inflator hose, and at least one surface gauge and wherein the apparatus has a total weight of up to 15 kg.

15. The use of an apparatus as defined in claim 1 for snorkeling with occasional and repeated scuba dives of up to 18 m.

16. The use of an apparatus as defined in claim 1 for training in open water diving to achieve certification therefor.

17. The device of claim 1, wherein an inflator mechanism for the flotation bladder is disposed in a shoulder portion.

18. The device of claim 1, wherein a dump valve and/or pressure release valve for the flotation bladder is disposed in a shoulder portion.

* * * * *